United States Patent [19]

Leu

[11] Patent Number: 4,706,951

[45] Date of Patent: Nov. 17, 1987

[54] APPARATUS FOR COLLATING DIFFERENTIATED PRINTED PRODUCTS

[75] Inventor: Willey Leu, Pfäffikon, Switzerland

[73] Assignee: Ferag AG, Hinwil, Switzerland

[21] Appl. No.: 910,386

[22] Filed: Sep. 22, 1986

[30] Foreign Application Priority Data

Sep. 27, 1985 [CH] Switzerland ..... 04202/85

[51] Int. Cl.[4] ..... B65H 5/30

[52] U.S. Cl. ..... 270/55; 271/204

[58] Field of Search ..... 270/54–58; 271/204, 184, 187, 287, 292, 296

[56] References Cited

U.S. PATENT DOCUMENTS

| | | | |
|---|---|---|---|
| 2,461,573 | 2/1949 | Schweizer | 270/55 |
| 2,892,627 | 6/1959 | Newhouse | 270/55 |
| 3,122,362 | 2/1964 | Vollrath et al. | 270/57 |
| 4,046,367 | 9/1977 | Merker et al. | 270/55 |
| 4,124,203 | 11/1978 | Muller | 270/55 |
| 4,133,521 | 1/1979 | Muller | 270/55 |
| 4,408,754 | 10/1983 | Meier | 270/21.1 |
| 4,479,643 | 10/1984 | Seidel | 270/55 |
| 4,489,930 | 12/1984 | Meier | 270/55 |
| 4,496,141 | 1/1985 | Nayate | 270/55 |
| 4,555,101 | 11/1985 | Stobb | 271/204 |

FOREIGN PATENT DOCUMENTS

| | | |
|---|---|---|
| 0095603 | 12/1983 | European Pat. Off. . |
| 0118596 | 9/1984 | European Pat. Off. . |
| 1260487 | 2/1968 | Fed. Rep. of Germany . |
| 2702738 | 9/1977 | Fed. Rep. of Germany . |

*Primary Examiner*—E. H. Eickholt

[57] ABSTRACT

A plurality of hoppers or bins which are product-loadable from above are uniformly spaced from each other and are transported along a path of conveyance. The hoppers or bins, each of which is bounded by two walls or faces which are substantially transverse to the direction of conveyance, pass by a plurality of individual infeed conveyors which are staggerdly arranged in the direction of conveyance. These individual infeed conveyors possess controllable grippers or clamps which are spaced from one another. These mutually spaced clamps or grippers are used to load or fill each hopper or bin with a printed product. The mutual spacing of successive clamps or grippers and their circulating speed substantially correspond to the mutual separation distance or spacing and the circulating speed of the hoppers or bins. In order to accommodate as many hoppers or bins as possible per unit length of the path of conveyance of the hoppers or bins and still assure the problem-free loading of the hoppers or bins, each individual infeed conveyor passes over the path of conveyance of the hoppers or bins with its product transfer or delivery region inclined or sloping towards the path of conveyance. Furthermore, the product transfer or delivery region of each individual infeed conveyor is provided with a guide plate in order to guide the freely suspended edges of the printed products into the loading or infeed opening of the hoppers or bins.

7 Claims, 5 Drawing Figures

APPARATUS FOR COLLATING DIFFERENTIATED PRINTED PRODUCTS

BACKGROUND OF THE INVENTION

The present invention broadly relates to a new and improved apparatus for collating differentiated or different types of printed products.

Generally speaking, the inventive apparatus for collating differentiated printed products is provided with a plurality of hoppers or bins substantially uniformly spaced from each other and transported along a path of conveyance. These hoppers or bins are loadable from above and each hopper or bin is bounded or defined by means of two walls or faces which are positioned substantially transverse to the direction of conveyance or circulation of the hoppers or bins. The printed products are individually infed into the hoppers or bins by means of at least one individual conveyor or product infeed conveyor which is provided with mutually spaced controllable clamps or grippers. These mutually spaced controllable clamps or grippers are positioned with substantially the same spacing as the hoppers or bins and circulate substantially synchronously together with and vertically above the hoppers or bins. These clamps or grippers of the at least one individual conveyor or infeed conveyor transport the printed products in a suspended manner at least in the region of a product transfer or delivery region of the individual conveyor or infeed conveyor.

An apparatus of this general type is known, for example, from the German Patent Publication No. 1,260,487, published Feb. 8, 1968. With this apparatus, printed products of a first type are inserted into hoppers or bins circulating in a vertical plane at the transition from the lower return run of the path of conveyance of the hoppers or bins by means of a feeder. An individual conveyor equipped with controllable clamps or grippers is positioned in the region of the then subsequent horizontally extending run of the path of conveyance of the hoppers or bins and serves as a further conveyor which inserts printed products of a second or further type. These printed products are then transported in a suspended manner in the product transfer or delivery region of the individual conveyor. This product transfer or delivery region of the individual conveyor moves synchronously with the circulating or revolving hoppers or bins as well as parallel to and with a substantial distance above the path of conveyance of the bins or hoppers. The printed product released from the grippers or clamps then freefalls into the predeterminate hopper or bin.

The design of the aforedescribed apparatus possesses the following substantial disadvantages. Since the printed products brought forward by the individual conveyors equipped with clamps or grippers should fall freely into the predeterminate hoppers or bins, their loading or infeed opening must be wide enough in order to achieve even an approximately satisfactory reliability of insertion of the printed products. A wide or large size loading or infeed opening of the hoppers or bins results, however, in a comparatively small quantity or number of hoppers or bins with any given length of the path of conveyance of the hoppers or bins. If one desires, however, to immediately collate the quantity or number of printed products per unit of time coming from a printing press with a small number of hoppers or bins, the speed of conveyance or circulation of the hoppers or bins as well as of the individual conveyors must be increased. This then again results in the printed products which are suspended in the product transfer or delivery region of the individual conveyor beginning to flutter uncontrollably and upon their release are hardly able to enter the loading or infeed opening of the predeterminate hopper or bin. The result of this is that the take-up or handling capacity of the known device does not in any way approximate the production capacity of a modern printing press.

Similar statements may be made about the known apparatuses as described in the Swiss Pat. No. 594,553, which is substantially identical in content with the German Patent Publication No. 2,702,738, or with the Swiss Pat. No. 594,554. So-called feeders or infeeders are provided for loading or feeding the hoppers or bins of these known apparatuses. These feeders or infeeders can be designed, for example, according to the Swiss Pat. No. 374,968. The product transfer or delivery end of this stationarily located feeder or infeeder substantially comprises two conveyor bands between whose runs which confront one another and which travel in the same direction a conveying gap or opening is formed for each printed product. If the printed product leaves this conveying gap or opening it is propelled or delivered into the hopper or bin which is just passing by. This design creates several different problems.

One of these problems consists in the synchronization of the different feeders or infeeders with the circulation or revolving movement or conveyance motion of the hoppers or bins such that a printed product leaving the conveying gap or opening also always enters a hopper or bin and that the subsequent printed product arrives at the subsequent hopper or bin. Therefore, in these known apparatuses, one of the walls of the hopper walls arranged in a V-shaped configuration of each of the hoppers or bins can be spread away from and pivoted toward the other wall. By means of an appropriate control of the pivotable wall of the hopper or bin, it is possible that the loading or infeed opening of the hopper or bin is enlarged or widened at the loading point or location and thus the reliability of insertion or product-charging by the feeder or infeeder is increased. On the other hand, this design of the hoppers or bins likewise results in the fact that the mutual spacing of the hoppers or bins may not be less than a predetermined amount. This leads to a comparatively small number or quantity of such hoppers or bins which can be accommodated per unit length of the path of conveyance of the hoppers or bins. If, however, a predetermined take-up or handling capacity of printed products of the known apparatuses is required, this could only be achieved by increasing the speed of circulation or revolving motion of the hoppers or bins.

Finally, the performance capacity or efficiency of these known devices is also limited by the fact that the feeder or infeeder can first then deposit a further printed product into the passing hopper or bin if the preceding printed product is completely and totally accepted in the preceding hopper or bin.

SUMMARY OF THE INVENTION

Therefore, with the foregoing in mind, it is a primary object of the present invention to provide and new and improved construction of an apparatus for collating differentiated or different types of printed products which does not exhibit the aforementioned drawbacks and shortcomings of the prior art constructions.

Another and more specific object of the present invention aims at providing a new and improved construction of an apparatus of the previously mentioned type in which the transfer or transition of the printed products from the individual conveyors into the therewith associated or related hopper or bin is accomplished in a controlled manner.

In keeping with the immediately preceding object, it is a further noteworthy object of the present invention to enable a controlled deposition of the products into the hoppers or bins such that it is possible to reduce the size of the filling or loading opening of the hoppers or bins, which in turn results in the fact that the number or quantity of hoppers or bins can be increased and with constant speed of circulation or conveyance, the performance or efficiency of the apparatus can thus be significantly increased.

Yet a further significant object of the present invention aims at providing a new and improved construction of an apparatus for collating differentiated or different types of printed products and which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus for collating differentiated printed products of the present invention is manifested by the features that the product transfer or delivery region of the individual conveyors is sloped towards the path of conveyance or revolving path of movement of the hoppers or bins and is provided with a guide means, such as a guide plate which guides the lower free edge of each printed product into the loading or filling opening of the corresponding or related hopper or bin.

Since the product transfer or delivery region of each individual conveyor coincides or at least partially coincides with the path of conveyance of the bins or hoppers to be filled or loaded i.e. extends in the direction of such path of conveyance, and since, moreover, the mutual distance or spacing of the clamps or grippers of each individual conveyor and their speed substantially correspond to that of the circulating or conveyed hoppers or bins, the loading or feeding of the hoppers or bins can be accomplished so-to-speak synchronously or in a synchronous or accompanied manner. The guide plate or guide means providing the guidance of the printed products furthermore assures that the lower edge of the printed products is introduced with certainty or positively into the predeterminate or related hopper or bin. By this means the loading or filling opening of the hoppers or bins can be kept relatively narrow which allows the number of hoppers or bins to be substantially increased with a given length of path of conveyance and thus also affords an increase in the take-up or handling capacity of printed products of the apparatus even without increasing the speed of hopper circulation or conveyance. A fluttering or flapping of the printed products in the product transfer or delivery region of the individual conveyors is practically eliminated.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
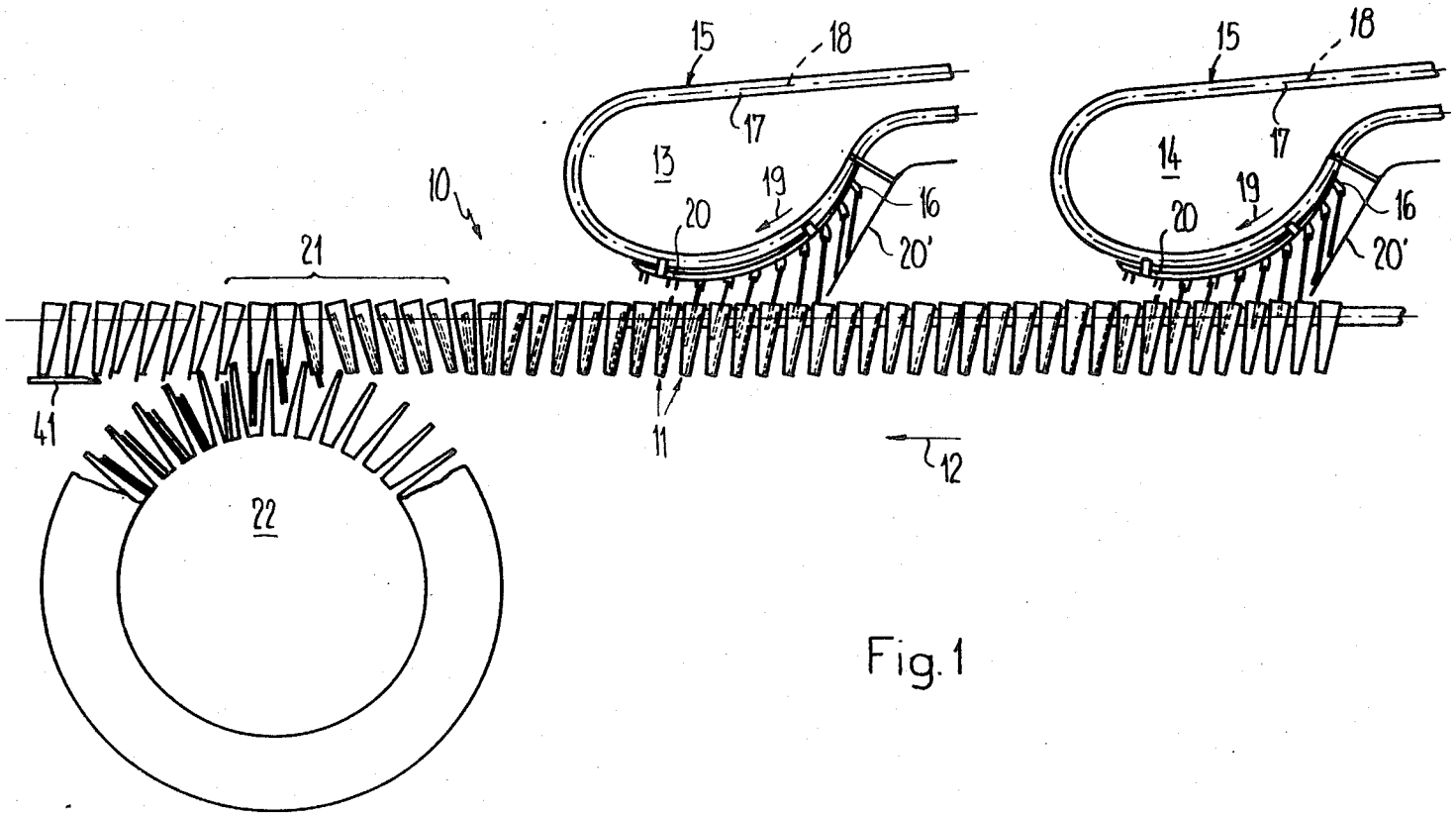
FIG. 1 schematically illustrates a side view of a portion of the inventive apparatus.

Describing now the drawings, it is to be understood that to simplify the showing thereof only enough of the structure of the apparatus for collating differentiated or different types of printed products has been illustrated therein as is needed to enable one skilled in the art to readily understand the underlying principles and concepts of this invention. Turning now specifically to FIG. 1 of the drawings, the apparatus 10 illustrated therein by way of example and not limitation, will be seen to comprise a plurality of substantially identical hoppers or bins 11—which also can be referred to as pockets—which are arranged at a substantially uniform distance or spacing from each other and are driven or conveyed along a closed or endless path of conveyance or revolving path of motion in the direction of the arrow 12. Only a portion of this path of conveyance is shown in FIG. 1 and this portion of the path of conveyance lies in a substantially horizontal plane. A plurality of substantially identical product feeder or infeed devices or conveyors are arranged along this path of conveyance of which only the product transfer or delivery regions of the feeder or infeed devices or conveyors 13 and 14 are shown in FIG. 1.

Each of these feeder or infeed devices or product infeed conveyors 13 and 14 comprise an overhead constructed individual conveyor or conveying means 15 whose construction may be substantially like that described in the U.S. Pat. No. 3,955,667. In reference to these feeder or infeed devices or conveyors 13 and 14 under discussion, it is only of importance that these individual conveyors 15 are equipped with controllable clamps or grippers 16 (cf. FIG. 2) for gripping or engaging an individual printed product or article being processed.

The clamps or grippers 16 of each of the individual conveyors 15 are attached, in mutual spaced relationship corresponding to the spacing of the hoppers or bins 11 from one another, to an endless traction member 18 or equivalent structure which is guided in a hollow rail 17. The traction member 18 is appropriately driven in the direction of the arrow 19 with a speed corresponding to the circulation or conveyance speed of the hoppers or bins 11.

Figure 2:
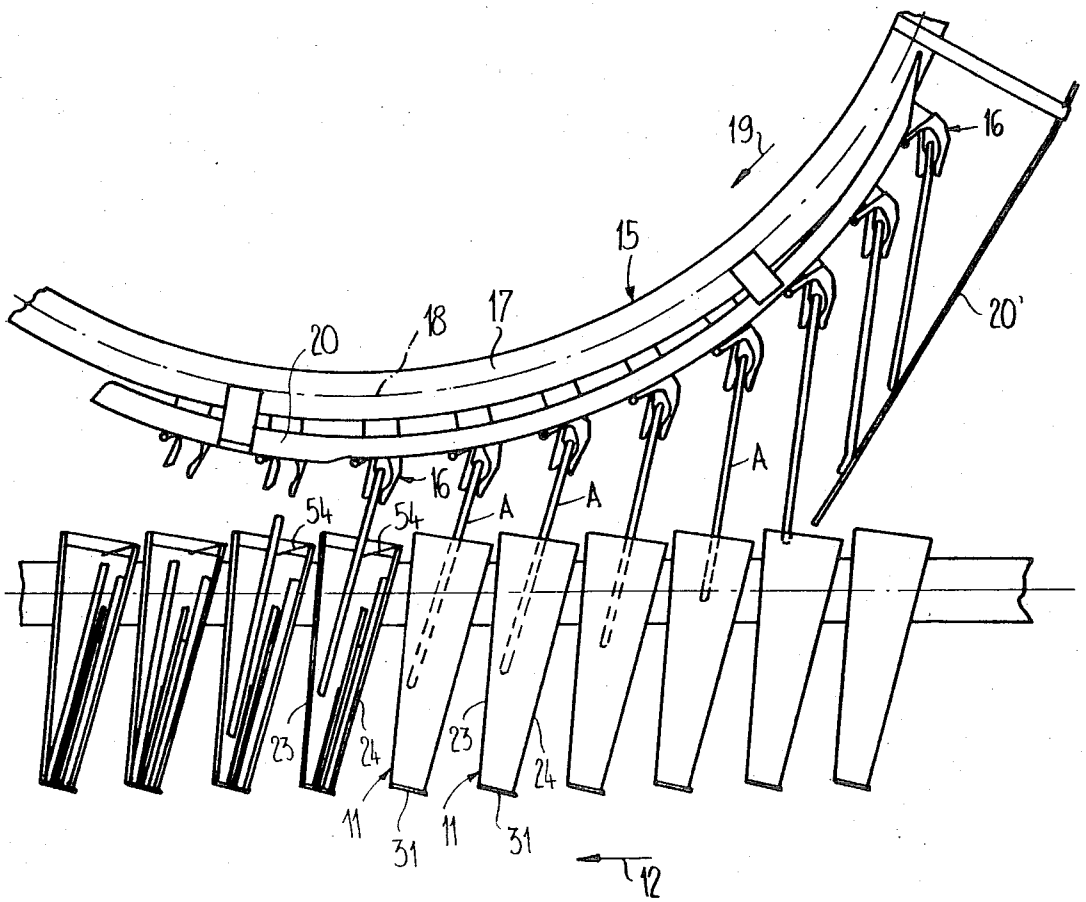
FIG. 2 schematically illustrates in enlarged scale a side view of the apparatus at a location of one of the individual infeed conveyors.

As clearly shown in FIG. 2, a cam track 20 for controlling or actuating the clamps or grippers 16 into their open position is attached to the hollow rail 17 and is provided in the product transfer or delivery region of each of the individual conveyors or conveyor means 15. Likewise there is positioned in the product transfer or delivery region of each of the individual conveyors 15 a guide means or guide plate 20' which is attached to the hollow rail 17. This guide means or guide plate 20' guides the leading or freely suspended edges of the infed printed products A precisely in the direction of the loading or infeed opening of one of the hoppers or bins 11. Thus the position of the leading edges of the printed products A is precisely defined in the product transfer or delivery region and hence any influence of the so-to-speak "travel wind", namely a flapping or fluttering of the products at high conveyor speeds of the individual conveyors 15, is thus prevented or avoided.

Each of the individual conveyors 15 which are associated with the apparatus 10 are fed or loaded with printed products at their respective input ends, for example, directly from a rotary printing press or from a stock supply or stock storage device. The individual conveyor 15 as illustrated, for example, in FIG. 2 thus loads or fills each passing hopper or bin 11 with a printed product of the sort or type A, whereas this hopper or bin 11 previously has already been loaded or filled with various different or other types of printed products as can be seen in FIG. 2. It can also be recognized from FIGS. 1 and 2 that the hoppers or bins 11 are to a certain degree rearwardly reclining in the product transfer or delivery region of the individual conveyors 15.

The region of a delivery station or location 21 for the hoppers or bins 11 is indicated in FIG. 1 with a curved bracket. During passage through this delivery station 21 the hoppers or bins 11 are first tipped or tilted from the rearwardly reclining position into a forwardly tilting or tilted position so that the printed products contained within the hoppers or bins 11 are tilted from their prior contact with one wall or face of each hopper or bin 11 so as to now contact the opposing hopper face or wall. Then the floor or bottom of each hopper or bin 11 is opened and the printed products now collated in a hopper or bin 11 into a printed product batch fall under their own weight downwardly into a device 22 which will not herein be further described for further processing of the printed products. This device 22 which serves for further processing of the printed products can be, for example, a collating stapler, a binding machine or an insertion machine as described in detail, for example, in its design as well as schematically illustrated in the Swiss Pat. No. 575,303 or the U.S. Pat. No. 4,058,202, the disclosure of which is incorporated herein by reference.

The means by which the hoppers or bins 11 are tipped or tilted from the rearwardly reclining or tilted position into the forwardly tilted position and by which the floors or bottoms of the hoppers or bins 11 are opened and closed will be described hereinafter reference to FIGS. 3 and 4.

Figure 3:
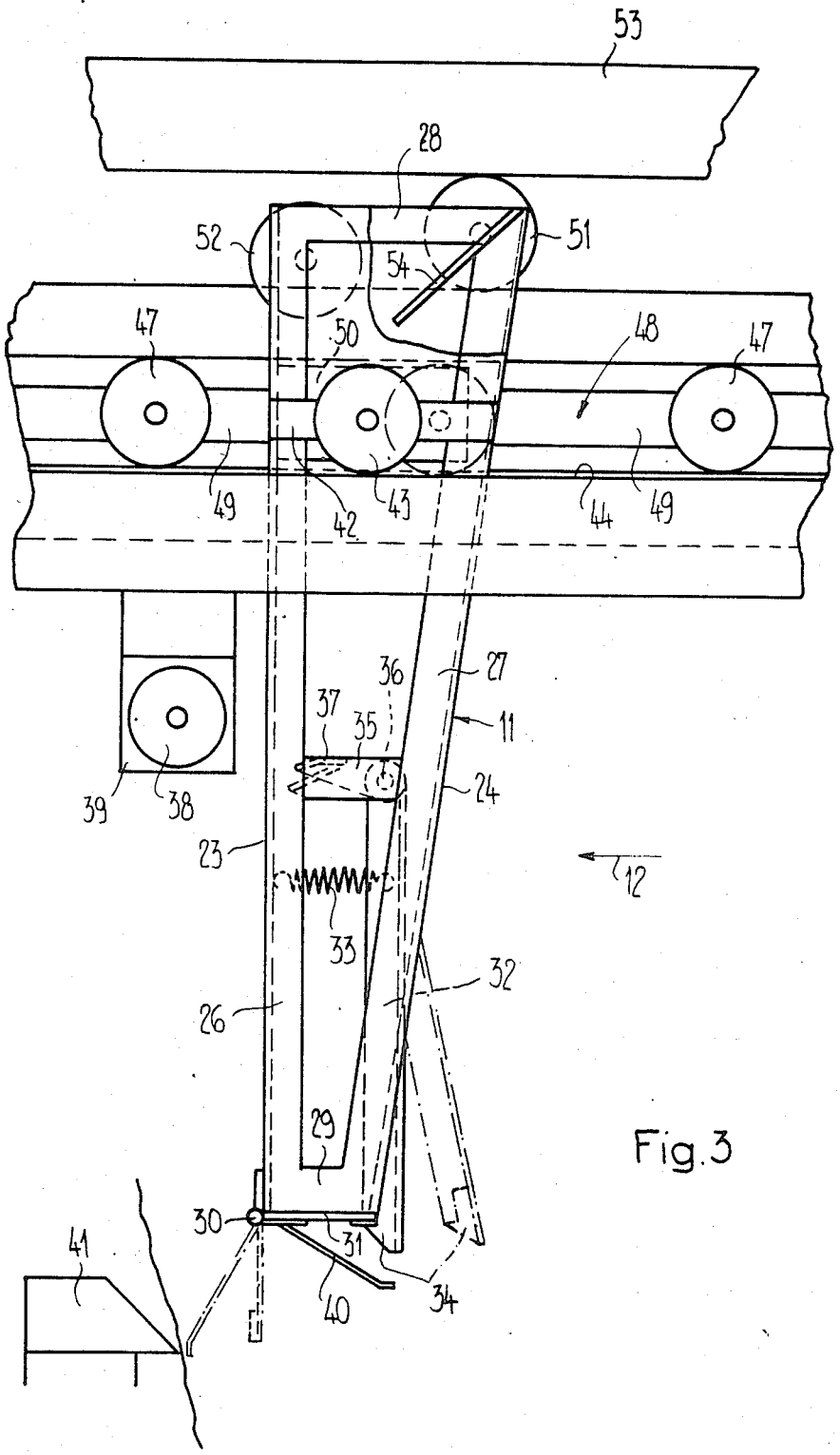
FIG. 3 is a side view of one of the hoppers or bins.

It can be seen from FIG. 3 that each hopper or bin 11 comprises a preceding or leading face or wall 23 and a trailing face or wall 24. Both of these hopper faces or walls 23 and 24 are formed by means of respective frames 26 and 27 formed from a L-shaped profile and covered with a wire grating or screen or grid 25 (cf. FIG. 4). The preceding or leading face or wall 23 and the trailing face or wall 24 are laterally held in a fixed or stationary reference position to one another at the top and bottom by means of respective struts 28 and 29 connecting the frames 26 and 27. At the lower edge of the leading face or wall 23, there is provided a lid or flap or trapdoor 31 which is pivotably attached at the location indicated by reference numeral 30 and which forms the floor or bottom of the hopper or bin 11. The lid or trapdoor 31 is normally held in a closed state or position by means of a latch or pawl 34 formed at the end of an arm of an angle lever or bell crank 32 or the like which is prebiased by means of a tension spring 33. From one of the struts 35 connecting the upright spars or brackets of the frames 26 and 27 which extend to the right as seen in the direction of circulation or conveyance (see FIG. 4) there laterally projects a pin or lug 36 upon which the angle lever or bell crank 32 is pivotably mounted or positioned. The other arm of the angle lever or bell crank 32 is provided with a contact surface 37. A roll or roller 38 coacting with the contact surface 37 is provided at the location of the delivery station 21. This roll or roller 38 is extendable into (as indicated by a broken line in FIG. 4) or retractable from (as indicated by a solid line in FIG. 4) the path of conveyance or path of revolving motion of the contact surface 37 by means of any suitable actuation element or device 39, for example, a fluid control device or a solenoid. If the roll or roller 38 is extended or advanced, the contact surface 37 is depressed as it passes by during its conveyance and the angle lever or bell crank 32 is rotated or pivoted in a counterclockwise direction (indicated in FIG. 3 with a broken line). The latch or pawl 34 thus now releases the free edge of the lid or flap or trapdoor 31 and this trapdoor 31 is opened as a result of the deadweight of the printed products lying thereabove, thus allowing the printed products which are in the hopper or bin 11 (but which printed products are not illustrated in FIG. 3) to fall downwardly, as is illustrated in FIG. 1 at the location of the delivery station 21.

After the contact surface 37 has passed the roll or roller 38, the tension spring 33 pivots or rotates the angle lever or bell crank 32 and thus the latch or pawl 34 back into its original or starting position while the flap or trapdoor 31 is still open. To close the flap or trapdoor 31 there is attached thereto a resilient closing bracket 40. As a result of the conveying movements, this closing bracket 40 runs up or comes up into contact with a closing cam track 41 (which is shown for simplicity in FIG. 3 at approximately the same location as the roll or roller 38) but which in reality is positioned subsequent to the roll or roller 38. This contact of the closing bracket 40 with the closing cam track 41 causes an upward tilting or closing of the flap or trapdoor 31 from the open position illustrated in FIG. 3 with a broken line into the closed position illustrated with a solid line, whereby the free edge of the flap or trapdoor 31 again latchingly engages with the latch or pawl 34.

Figure 4:
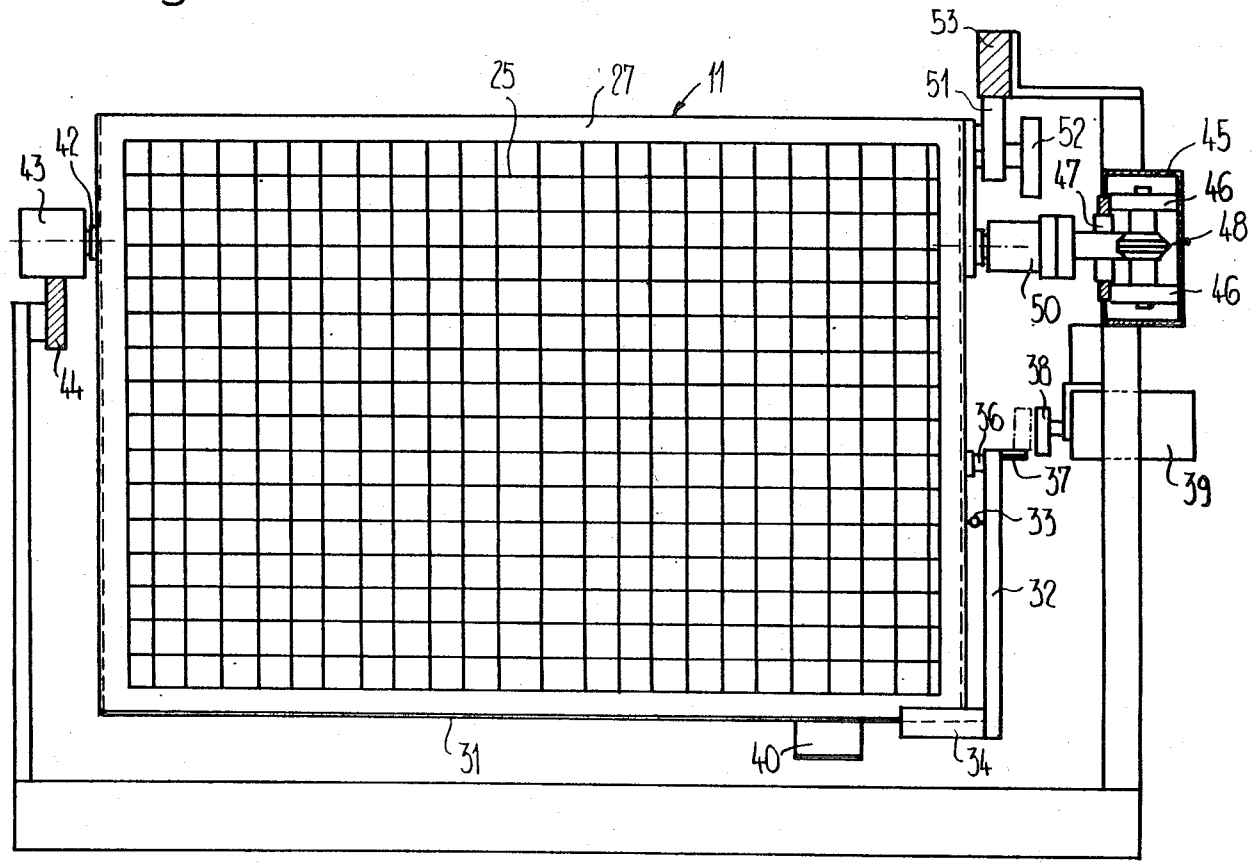
FIG. 4 is a front view of one of the hoppers or bins.

At the left side of FIG. 4 a strut or bracket 42 connecting the frames 26 and 27 supports a laterally projecting, freely rotatable roll or roller 43. This roll or roller 43 rolls along a support rail 44 which encircles or surrounds the entire path of conveyance of the hoppers or bins 11. Thus all hoppers or bins 11 are supported on the support rail 44.

At the side of the hopper or bin 11 which appears in the right of FIG. 4 there is positioned a hollow rail 45 which is substantially C-shaped in cross-section and is open towards the side which confronts the hoppers or bins 11. This hollow rail 45 serves for guiding a drive means 48, for example a chain, which is provided with rolls or rollers 46 and 47. This drive means or chain 48 can be designed, for example, as is described in the Swiss Pat. No. 588,647. At each connecting strap or bar or bracket 49 provided between the adjacent rolls or rollers 47 of the drive means or chain 48 there is coupled by means of an entraining coupling piece 50 the side of a related hopper or bin 11 which appears in the right-hand of FIG. 4 such that this hopper or bin 11 is capable of carrying out a pendulum-like motion about an axis which is coaxial to the axis of the roll or roller 43.

Each hopper or bin 11 supports on its side which confronts the drive means or chain 48 two further freely rotating following or follower members, for example, freely rotating rolls or rollers 51 and 52 so that the position or attitude of each hopper or bin 11 is continuously defined or determinate during its conveyance or revolving motion. The axes of rotation of these follower members or rollers 51 and 52 are offset with respect to the axis about which the hoppers or bins 11 can pendulate or swing to the rear and to the front respectively as seen in the direction of conveyance of the hoppers or bins 11. The following or follower members or rollers 51 and 52 alternately act with each of an associated cam track or cam during the conveyance of the associated hopper or bin 11, of which only the cam track or cam 53 operatively associated with the following member or roller 51 is conveniently illustrated in FIGS. 3 and 4.

With a downwardly sloping contact surface of the cam track or cam 53 as seen in the direction of conveyance of the hoppers or bins 11, the following member or roller 51 is thus depressed by its contact with this downwardly sloping cam track 53. Thus the hopper or bin 11 is tilted or tipped in a rearwardly reclining position as is illustrated in FIG. 2. On the other hand, if the following member or roller 52 is downwardly depressed by means of the other associated, however, not here illustrated cam track, then the hopper or bin 11 is pivoted or tilted from the rearwardly reclining position into the forwardly tilted position as is illustrated in FIG. 1 at the beginning or starting portion of the delivery station 21.

It can also be seen in FIG. 3 that at the upper edge of the trailing wall or face 24 of each hopper or bin 11 a deflector plate 54 is attached which extends over the entire width of the loading or filling opening of the related hopper or bin 11. The function of this deflector plate 54 can clearly be recognized from FIG. 2. In the region of the product transfer or delivery end of each individual conveyor 15 the hopper or bins 11 are controlled by the described means such that they remain in the rearwardly reclining or tilted position as these hoppers or bins pass by the individual conveyors 15. Thus each product infed or delivered into the associated hopper or bin 11 after completely passing through the insertion or infeed slot or opening of the hopper or bin 11 which is limited between or bounded by the free edge of the deflector plate 54 and the leading hopper wall or face 23 comes to rest on the trailing hopper face or wall 24 or, as the case may be, comes to rest on the products already present in this hopper or bin 11 so that the filling or loading of such hopper or bin 11 with further printed products is not hindered in any way. Shortly before the emptying or discharging of the contents of the hopper or bin 11, the hopper or bin 11 is tipped or tilted into the forwardly tilted position and during the emptying process is again tipped or tilted back into the rearwardly reclining position. Thus during the emptying of the hopper or bin 11, the floor or bottom opening of the hopper or bin 11 which is freed by means of the flap or trapdoor 31 somewhat leads or is ahead of the conveyance of the hopper or bin 11. This facilitates the discharge or delivery of the printed products collected or collated within the hopper or bin 11.

One possible field of application of the inventive apparatus 10 will be briefly discussed below with reference to FIG. 5 in connection with, for example, an insertion or stuffing machine 22 corresponding to the previously mentioned Swiss Pat. No. 575,303.

Figure 5:
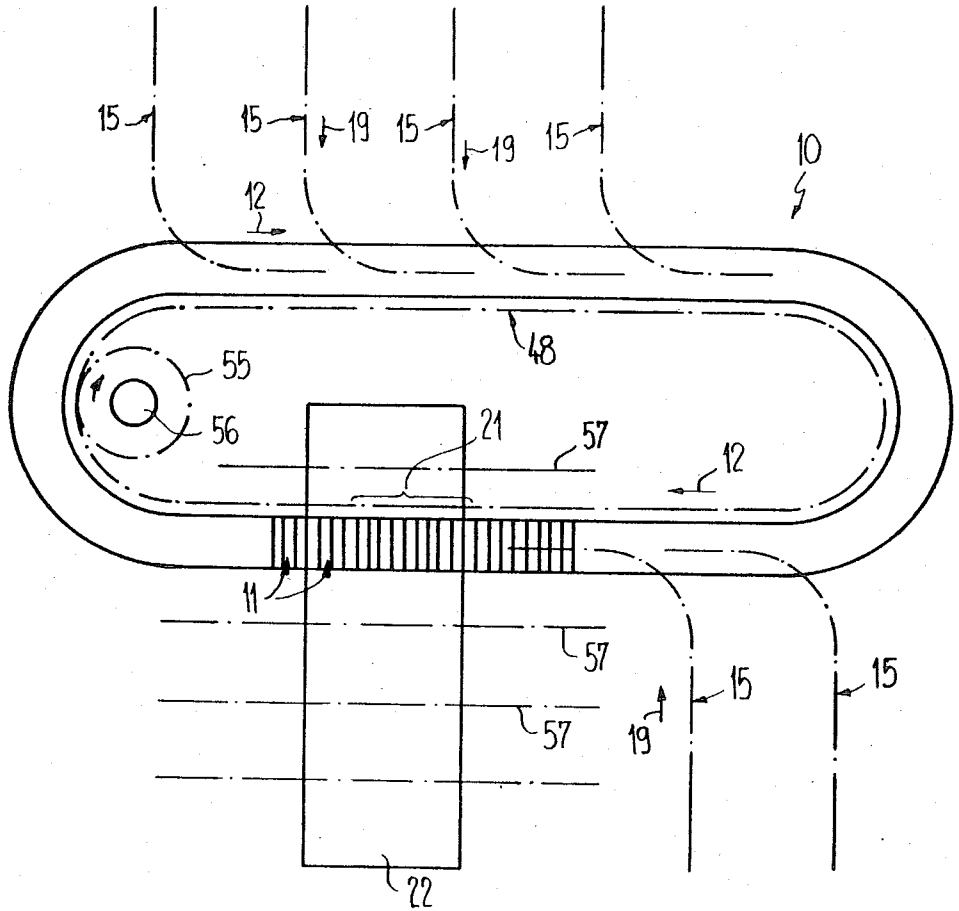
FIG. 5 illustrates a schematic plan view of an exemplary application of the inventive apparatus.

The path of conveyance of the hoppers or bins 11 is illustrated by two oval solid lines in the schematic plan view of FIG. 5. The drive means or chain 48 which entrains the hoppers or bins 11 is indicated with a chain-dot oval line. The drive wheel or sprocket or the like which drives the drive means or chain 48 is indicated with a chain-dot circle 55 and a drive motor which is operatively coupled to the drive wheel 55 is indicated with the reference numeral 56. There can be recognized a total of six individual conveyors 15 which merge with or discharge into the path of conveyance of the hoppers or bins 11. The path of conveyance of the hoppers or bins 11 grazes or is tangential to the top or overhead portion of the bucket or compartmentalized or cell wheel of the insertion or stuffing machine 22. This bucket or compartmentalized or cell wheel has a horizontal axis of rotation. The delivery station 21 is located in the region of this bucket or compartmentalized or cell wheel.

It is therefore possible with the apparatus 10 illustrated in FIG. 5 to simultaneously infeed or feed six collected or collated printed products to the bucket or compartmentalized or cell wheel at a single infeed location of the insertion or stuffing machine 22. Additional infeed locations of the insertion or stuffing machine 22 are indicated in FIG. 5 with straight chain-dot lines 57. These additional infeed locations can also be served by means of the apparatus 10.

It is not necessary that the path of conveyance or path of motion of the hoppers or bins 11 of the previously described apparatus 10 travel in a horizontal plane. The hoppers or bins 11, due to their pendulum-like suspension about an axis which extends substantially perpendicular to the drive means or chain 48 and is substantially parallel to the hopper faces or walls 23 and 24 can be controlled in their attitude or tilt such that they can be reliably fed or loaded from above, that is to say from overhead, even with upwardly sloping or downwardly sloping sections of the path of conveyance or path of revolving motion of the drive means or chain 48.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for collating differentiated printed products, comprising:

a plurality of mutually and substantially uniformly spaced hoppers;

said hoppers being transported along a path of conveyance in a predetermined direction of conveyance;

each of said hoppers having a loading opening and being loadable from above;

each hopper being bounded by at least two walls which extend substantially transverse to the predetermined direction of conveyance of said hoppers along said path of conveyance;

at least one product infeed conveyor for individually infeeding the printed products into said hoppers;

said at least one product infeed conveyor being provided with a plurality of mutually spaced controllable clamps located above said hoppers and having substantially the same mutual spacing from one another as said mutually and substantially uniformly spaced hoppers and said plurality of mutually spaced controllable clamps revolving substantially synchronously with said hoppers;

said at least one product infeed conveyor having a product transfer region;

said plurality of mutually spaced controllable clamps transporting the printed products in a suspended manner at least in said product transfer region of said at least one product infeed conveyor such that the printed products have a lower free edge;

said product transfer region of said at least one product infeed conveyor being inclined to said path of conveyance of said hoppers;

guide means provided for said product transfer region; and said guide means guiding said lower free edge of each printed product into said loading opening of a momentarily related one of said hoppers.

2. The apparatus as defined in claim 1, further including:

an endless circulating drive means moving along a predetermined direction of travel;

means for operatively connecting said hoppers to said endless circulating drive means;

said operatively connecting means connecting said hoppers with said endless circulating drive means such that each of said hoppers has an axis of rotation which is disposed substantially perpendicular to at least a portion of the predetermined direction of travel of said endless circulating drive means and which lies substantially in a horizontal plane and with said axis of rotation of each hopper located substantially parallel to said at least two walls of said hopper; and said hoppers being coupled by said operatively connecting means to said drive means such that each of said hoppers is capable of oscillating in a pendulum-like fashion about its associated axis of rotation.

3. The apparatus as defined in claim 2, further including:

at least one follower member provided for each said hopper;

a stationary cam track; and said at least one follower member of each said hopper coacting with said stationary cam track in order to change the angle of inclination of each said hopper in relation to said path of conveyance of said hoppers.

4. The apparatus as defined in claim 3, wherein: said at least one follower member comprises a roller.

5. The apparatus as defined in claim 1, further including:

a deflector plate provided for each of said hoppers;

each of said hoppers having a floor and an upper edge; and each said deflector plate being positioned substantially near to said upper edge of one of said at least two walls of its hopper and being substantially inclined to the other wall of said at least two walls of said hopper and to said floor of said hopper.

6. The apparatus as defined in claim 2, further including:

a support rail;

each of said hoppers having oppositely located sides;

a respective freely rotatable roller provided for each of said hoppers; and each of said hoppers being connected at one side thereof to said drive means and at the other side thereof being supported on said support rail by means of said freely rotatable roller.

7. The apparatus as defined in claim 6, wherein:

each of said freely rotatable rollers possesses a first axis of rotation;

said axis of rotation of each hopper defines a respective second axis of rotation about which said hopper is coupled to said drive means such that each said hopper is capable of oscillating in a pendulum-like fashion; and said first axis of rotation of said freely rotatable roller being disposed substantially coaxial to said second axis of rotation of the related hopper.

* * * * *

US004706951B1

REEXAMINATION CERTIFICATE (2039th)

United States Patent [19]

Leu

[11] B1 4,706,951

[45] Certificate Issued Jun. 15, 1993

[54] APPARATUS FOR COLLATING DIFFERENTIATED PRINTED PRODUCTS

[75] Inventor: Willey Leu, Pfäffikon, Switzerland

[73] Assignee: Ferag AG, Hinwil, Switzerland

Reexamination Request:
No. 90/002,736, May 28, 1992

Reexamination Certificate for:

| | |
|---|---|
| Patent No.: | **4,706,951** |
| Issued: | **Nov. 17, 1987** |
| Appl. No.: | **910,386** |
| Filed: | **Sep. 22, 1986** |

[30] Foreign Application Priority Data

Sep. 27, 1985 [CH] Switzerland ..... 04202/85

[51] Int. Cl.[5] ..... B65H 5/30
[52] U.S. Cl. ..... 270/55; 271/204
[58] Field of Search ..... 270/54, 55, 56, 57, 270/58

[56] References Cited

U.S. PATENT DOCUMENTS

| | | | |
|---|---|---|---|
| 2,461,573 | 2/1949 | Schweizer | 270/55 |
| 2,892,627 | 6/1959 | Newhouse | 270/55 |
| 3,122,362 | 2/1964 | Vollrath et al. | 270/57 |
| 3,825,246 | 7/1974 | Elia et al. | 270/54 X |
| 3,955,667 | 11/1976 | Muller et al. . | |
| 4,046,367 | 9/1977 | Merker et al. | 270/55 |
| 4,058,202 | 11/1977 | Reist et al. | 270/55 X |
| 4,116,427 | 9/1978 | Muller | 270/54 |
| 4,124,203 | 11/1978 | Muller | 270/55 |
| 4,133,521 | 1/1979 | Muller | 270/55 |
| 4,408,754 | 10/1983 | Meier | 270/21.1 |
| 4,471,953 | 9/1984 | Reist et al. | 270/54 |
| 4,479,643 | 10/1984 | Seidel | 270/55 |
| 4,489,930 | 12/1984 | Meier | 270/55 |
| 4,496,141 | 1/1985 | Nayate | 270/55 |
| 4,555,101 | 11/1985 | Stobb | 271/204 |

FOREIGN PATENT DOCUMENTS

| | | |
|---|---|---|
| 0095603 | 12/1983 | European Pat. Off. . |
| 0118596 | 9/1984 | European Pat. Off. . |
| 1260487 | 2/1968 | Fed. Rep. of Germany . |
| 2702738 | 9/1977 | Fed. Rep. of Germany . |
| 374968 | 3/1964 | Switzerland . |
| 594554 | 1/1978 | Switzerland . |

*Primary Examiner*—Ed Look

[57] ABSTRACT

A plurality of hoppers or bins which are product-loadable from above are uniformly spaced from each other and are transported along a path of conveyance. The hoppers or bins, each of which is bounded by two walls or faces which are substantially transverse to the direction of conveyance, pass by a plurality of individual infeed conveyors which are staggerdly arranged in the direction of conveyance. These individual infeed conveyors possess controllable grippers or clamps which are spaced from one another. These mutually spaced clamps or grippers are used to load or fill each hopper or bin with a printed product. The mutual spacing of successive clamps or grippers and their circulating speed substantially correspond to the mutual separation distance or spacing and the circulating speed of the hoppers or bins. In order to accommodate as many hoppers or bins as possible per unit length of the path of conveyance of the hoppers or bins and still assure the problem-free loading of the hoppers or bins, each individual infeed conveyor passes over the path of conveyance of the hoppers or bins with its product transfer or delivery region inclined or sloping towards the path of conveyance. Furthermore, the product transfer or delivery region of each individual infeed conveyor is provided with a guide plate in order to guide the freely suspended edges of the printed products into the loading or infeed opening of the hoppers or bins.

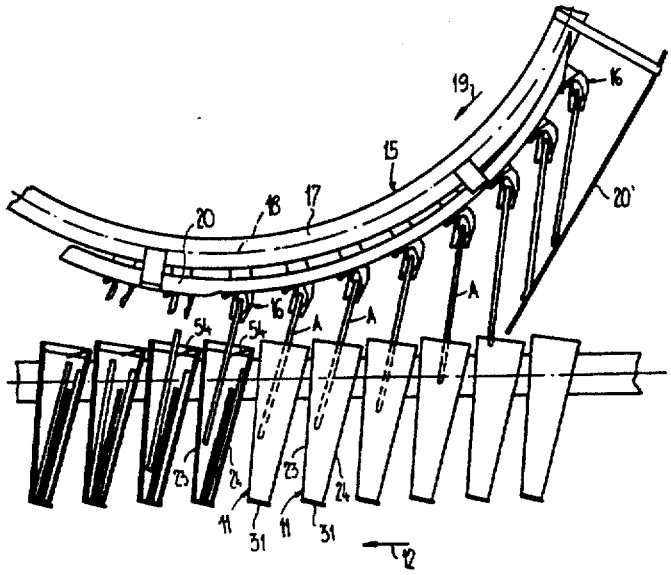

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 3 are determined to be patentable as amended.

Claims 4–7, dependent on an amended claim, are determined to be patentable.

New claims 8–25 are added and determined to be patentable.

1. An apparatus for collating differentiated printed products, comprising:

*an endless circulating flexible drive means which can be driven in circulation along a closed path of conveyance;* a plurality of [mutually and substantially uniformly spaced] hoppers;

said hoppers being *mounted at regular intervals from one another on said drive means for being* transported along [a] *said* path of conveyance in a predetermined direction of conveyance;

each of said hoppers having a loading opening and being loadable from above;

each hopper being bounded by at least two walls which extend substantially transverse to the predetermined direction of conveyance of said hoppers along said path of conveyance;

[at least one] *a plurality of* produced infeed [conveyor] *conveyors arranged successively in the predetermined direction of conveyance of said hoppers* for individually infeeding the printed products into said hoppers;

*each of* said [at least one product] infeed [conveyor] *conveyors* being provided with a plurality of [mutually] *regularly* spaced controllable clamps located above said hoppers and having substantially the same [mutual] *regular* spacing from one another as said [mutually and substantially uniformly] *regularly* spaced hoppers [and], said plurality of [mutually] *regularly* spaced controllable clamps revolving substantially synchronously with said hoppers;

*each of* said [at least one product] infeed [conveyor] *conveyors* having a product transfer region;

said plurality of [mutually] *regularly* spaced controllable clamps transporting the printed products in a suspended manner at least in said product transfer region of *each of* said [at least one product] infeed [conveyor] *conveyors* such that the printed products have a lower free edge;

*each of* said product transfer [region] *regions* of *each of* said [at least one product] infeed [conveyor] *conveyors* being inclined to said path of conveyance of said hoppers;

guide means provided for *each of* said product transfer [region] *regions*; and

*each of* said guide means guiding said lower free edge of each printed product into said loading opening of a momentarily related one of said hoppers.

2. The apparatus as defined in claim 1, further including:

[an endless circulating drive means moving along a predetermined direction of travel;]

means for operatively connecting said hoppers to said endless circulating drive means;

[said operatively connecting means connecting] *wherein* said hoppers [with] *are mounted on* said endless circulating drive means such that each of said hoppers has an axis of rotation which is disposed substantially perpendicular to at least a portion of the predetermined direction of [travel] *conveyance* of said endless circulating drive means and which lies substantially in a horizontal plane and which said axis of rotation of each hopper located substantially parallel to said at least two walls of said hopper; and said hoppers [being coupled by said operatively connecting means] *are mounted* to said drive means such that each of said hoppers is capable of oscillating in a pendulum-like fashion about [its associated] *a first* axis of rotation *running perpendicular to the direction of conveyance and parallel to the walls of said hoppers.*

3. The apparatus as defined claim [2, further including] *8, wherein said means for changing includes:* at least one follower member provided for each said hopper;

a stationary cam track; and said at least one follower member of each said hopper coacting with said stationary cam track in order to change the angle of inclination of each said hopper in relation to said path of conveyance of said hoppers.

*8. The apparatus as defined in claim 2, further comprising:*

*means for changing the angle of inclination of each said hopper in relation to the circulation path of said hoppers.*

*9. The apparatus as defined in claim 1, wherein each of said hoppers includes an openable floor, and further comprising:*

*means for opening the floor of each hopper to remove collated printed products from said hoppers.*

*10. The apparatus as defined in claim 9, wherein the openable floors of said hoppers include a lockable flap, and said means for opening includes an opening device, located at a delivery station, for unlocking said lockable flaps.*

*11. The apparatus as defined in claim 3, wherein each hopper has a floor, and said at least one follower member of each said hopper and said stationary cam track are arranged so that each said hopper is inclined with said floor facing forward with respect to said direction of conveyance when said hopper is located at the product transfer regions of said individual infeed conveyors, and so that each said hopper is inclined with said floor facing rearwardly with respect to said direction of conveyance when said hopper is located at a delivery station.*

*12. The apparatus as defined in claim 1, wherein said closed path through which said drive means circulates is in*

*a horizontal plane so that said drive means rotates about a vertical axis.*

*13. An apparatus for collating differentiated printed products, comprising:*

*an endless circulating drive means moving along a predetermined direction of travel;*

*a plurality of mutually and substantially uniformly spaced hoppers;*

*means for operatively connecting said hoppers to said endless circulating drive means;*

*said hoppers being transported along a path of conveyance in a predetermined direction of conveyance by said endless circulating drive means;*

*each of said hoppers having a loading opening and being loadable from above;*

*each hopper being bounded by at least two walls which extend substantially transverse to the predetermined direction of conveyance of said hoppers along said path of conveyance;*

*said operatively connecting means connecting said hoppers with said endless circulating drive means such that each of said hoppers has an axis of rotation which is disposed substantially perpendicular to at least a portion of the predetermined direction of travel of said endless circulating drive means and which lies substantially in a horizontal plane and with said axis of rotation of each hopper located substantially parallel to said at least two walls of said hopper;*

*said hoppers being coupled by said operatively connecting means to said drive means such that each of said hoppers is capable of oscillating in a pendulum-like fashion about its associated axis of rotation;*

*at least one product infeed conveyor for individually infeeding the printed products into said hoppers;*

*said at least one product infeed conveyor being provided with a plurality of mutually spaced controllable clamps located above said hoppers and having substantially the same mutual spacing from one another as said mutually and substantially uniformly spaced hoppers and said plurality of mutually spaced controllable clamps revolving substantially synchronously with said hoppers;*

*said at least one product infeed conveyor having a product transfer region;*

*said plurality of mutually spaced controllable clamps transporting the printed products in a suspended manner at least in said product transfer region of said at least one product infeed conveyor such that the printed products have a lower free edge;*

*said product transfer region of said at least one product infeed conveyor being inclined to said path of conveyance of said hoppers;*

*guide means provided for said product transfer region; and*

*said guide means guiding said lower free edge of each printed product into said loading opening of a momentarily related one of said hoppers.*

*14. The apparatus as defined in claim 13, further including:*

*at least one follower member provided for each said hopper;*

*a stationary cam track; and*

*said at least one follower member of each said hopper coacting with said stationary cam track in order to change the angle of inclination of each said hopper in relation to said path of conveyance of said hoppers.*

*15. The apparatus as defined in claim 14, wherein said at least one follower member comprises a roller.*

*16. The apparatus as defined in claim 13, further including:*

*a deflector plate provided for each of said hoppers;*

*each of said hoppers having a floor and an upper edge; and*

*each said deflector plate being positioned substantially near to said upper edge of one of said at least two walls of its hopper and being substantially inclined to the other wall of said at least two walls of said hopper and to said floor of said hopper.*

*17. The apparatus as defined in claim 13, further including:*

*a support rail;*

*each of said hoppers having oppositely located sides;*

*a respective freely rotatable roller provided for each of said hoppers; and*

*each of said hoppers being connected at one side thereof to said drive means and at the other side thereof being supported on said support rail by means of said freely rotatable roller.*

*18. The apparatus as defined in claim 17, wherein:*

*each of said freely rotatable rollers possesses a first axis of rotation;*

*said axis of rotation of each hopper defines a respective second axis of rotation about which said hopper is coupled to said drive means such that each said hopper is capable of oscillating in a pendulum-like fashion; and*

*said first axis of rotation of said freely rotatable roller being disposed substantially coaxial to said second axis of rotation of the related hopper.*

*19. The apparatus as defined in claim 1, wherein said hoppers are mounted to said drive means such that each of said hoppers is capable of oscillating about a first axis of rotation running perpendicular to the direction of conveyance and parallel to the walls of said hoppers.*

*20. The apparatus as defined in claim 19, further including:*

*a support rail;*

*each of said hoppers having oppositely located sides;*

*a respective freely rotatable roller provided for each of said hoppers; and*

*each of said hoppers being connected at one side thereof to said drive means and at the other side thereof being supported on said support rail by means of said freely rotatable roller.*

*21. The apparatus as defined in claim 20, wherein:*

*each of said freely rotatable rollers possesses a first axis of rotation;*

*said axis of rotation of each hopper defines a respective second axis of rotation about which said hopper is coupled to said drive means such that each said hopper is capable of oscillating in a pendulum-like fashion; and*

*said first axis of rotation of said freely rotatable roller being disposed substantially coaxial to said second axis of rotation of the related hopper.*

*22. The apparatus as defined in claim 19, further comprising:*

*means for changing the angle of inclination of each said hopper in relation to the circulation path of said hoppers.*

*23. The apparatus as defined in claim 22, wherein said means for changing includes:*

*at least one follower member provided for each said hopper;*

*a stationary cam track; and*

*said at least one follower member of each said hopper coacting with said stationary cam track in order to change the angle of inclination of each said hopper in relation to said path of conveyance of said hoppers.*

*24. The apparatus as defined in claim 23, wherein each hopper has a floor, and said at least one follower member of each said hopper and said stationary cam track are arranged so that each said hopper is inclined with said floor facing forward with respect to said direction of conveyance when said hopper is located at the product transfer regions of said individual infeed conveyors, and so that each said hopper is inclined with said floor facing rearwardly with respect to said direction of conveyance when said hopper is located at a delivery station.*

*25. The apparatus as defined in claim 23, wherein said at least one follower member comprises a roller.*

* * * * *